United States Patent [19]

Coshow

[11] Patent Number: 4,624,313

[45] Date of Patent: Nov. 25, 1986

[54] WELL TOOL DISLODGEMENT APPARATUS

[76] Inventor: Chester L. Coshow, P.O. Box 843, Chickasha, Okla. 73018

[21] Appl. No.: 748,039

[22] Filed: Jun. 24, 1985

[51] Int. Cl.[4] ..... E21B 17/10

[52] U.S. Cl. ..... 166/241

[58] Field of Search ..... 166/241, 170; 175/325, 175/4.51; 308/4 A; 15/104.16, 104.2; 16/29, 31 R, 31 A, 18 R

[56] References Cited

U.S. PATENT DOCUMENTS

| | | | |
|---|---|---|---|
| 202,519 | 4/1878 | Chapin | 15/104.16 |
| 226,740 | 4/1880 | Gable | 15/104.16 |
| 762,081 | 6/1904 | McNulty | 16/18 |
| 1,281,756 | 10/1918 | Black | 308/4 A |
| 1,298,131 | 3/1919 | Wilkirson | 166/241 |
| 1,338,917 | 5/1920 | Hall | 15/162 |
| 1,339,955 | 5/1920 | Hardel | 166/254 |
| 2,292,938 | 8/1942 | Hennessy | 255/1 |
| 2,329,876 | 9/1943 | Castellano | 285/90 |
| 2,812,587 | 11/1957 | Roussin | 33/178 |
| 2,870,541 | 1/1959 | Mayes | 33/178 |
| 2,964,110 | 12/1960 | Garwood et al. | 166/241 |
| 3,092,182 | 6/1963 | Blagg | 166/241 |
| 3,364,464 | 1/1968 | Dellinger | 340/18 |
| 3,401,988 | 9/1968 | Pingree | 308/4 A |
| 3,572,442 | 3/1971 | Templeton | 166/212 |
| 3,977,468 | 8/1976 | Brewer et al. | 166/241 |
| 3,978,924 | 9/1976 | Roesner | 166/241 |
| 3,984,627 | 10/1976 | Galerne | 178/6.8 |
| 4,243,099 | 1/1981 | Rodgers, Jr. | 166/241 |
| 4,474,235 | 10/1984 | Coshow | 166/241 |

*Primary Examiner*—Stephen J. Novosad
*Assistant Examiner*—Bruce M. Kisliuk
*Attorney, Agent, or Firm*—Laney, Dougherty, Hessin & Beavers

[57] ABSTRACT

A sleeve attachable to a tool to be lowered into an uncased well bore has at least one roller mechanism connected in longitudinal relationship therewith so that the roller mechanism is disposed beneath the tool as the tool is lowered into the well bore. The roller mechanism has a plurality of radially extending protuberances obliquely disposed around the periphery of the roller mechanism. The protuberances grippingly engage the wall of the well bore so that the roller mechanism rotates to roll the tool off of any ledges encountered along the wall. The oblique disposition of the protuberances also imparts a rotational kick to the tool to move it away from the wall into the bore for permitting further lowering of the tool into the well bore.

11 Claims, 10 Drawing Figures

WELL TOOL DISLODGEMENT APPARATUS

BACKGROUND OF THE INVENTION

This invention relates generally to apparatus for assisting the lowering of an object into a well and more particularly, but not by way of limitation, to apparatus for preventing a logging tool from becoming stuck on a ledge of an uncased well bore.

An uncased well bore often has identations in the wall defining the bore. These indentations have ledges upon which an elongated logging tool being lowered into the well can become lodged or stuck. It has been the practice that when a tool becomes stuck on such a ledge, the tool be moved up and down (called "yo-yoing" the tool) until the tool is dislodged from the ledge. This "yo-yoing" is often time-consuming because it can take several up-and-down repetitions to dislodge the tool, and it is sometimes totally ineffectual. "Yo-yoing" may even damage the tool if it causes the tool to be banged into the ledge too often or too hard.

To enhance the effectiveness of the "yo-yoing" procedure or to preclude the necessity of "yo-yoing", there is the need for a roller mechanism which can be connected to a tool which is to be lowered into a well. Although there are presently disclosed downhole tool devices which have wheels, these wheels generally extend laterally from the tool so that they can ride along the interior surface of the casing or the surface of the wall defining the uncased well bore. One apparatus having a wheel mechanism extending directly beneath a tool as it is lowered into a well is disclosed in my previously issued patent, U.S. Pat. No. 4,474,235. The apparatus disclosed in this previously issued patent has been in public use for more than one year.

Although the apparatus disclosed in my aforementioned patent satisfies the basic need for a device to enhance or preclude "yo-yoing," I have improved my original concept to enhance its operability.

SUMMARY OF THE INVENTION

The present invention provides a novel and improved apparatus for assisting in the lowering of an element into a well. The improvements over my previous invention disclosed in U.S. Pat. No. 4,474,235 are primarily directed to enhancing the ability of the apparatus to prevent lodgment against the wall of a well bore.

Broadly, the present invention provides an apparatus for assisting the lowering of an object into a well so that the tool or other object is prevented from becoming stuck on a ledge or other formation defined in a wall which defines an uncased well bore of the well. The apparatus includes adapter shoe means for coupling the apparatus with the object. The adapter shoe means has a first end and a second end spaced from the first end. The apparatus also includes roller means for engaging the wall of the well. The roller means includes a plurality of protuberances defined along the periphery thereof so that the protuberances engage the wall of the well to rotate the roller means thereby tending to prevent the object from becoming stuck against the wall when the adapter shoe means couples the apparatus with the object and the object is lowered into the well. In the preferred embodiment these protuberances are angularly disposed along the periphery of the roller means so that engagement with the wall of the well also tends to rotate the object, thereby kicking the object away from the wall to prevent lodgment. The apparatus also includes roller attachment means for attaching the roller means near the second end of the adapter shoe means.

In one preferred embodiment the apparatus further comprises another roller means having another plurality of protuberances defined along the periphery thereof and another roller attachment means for attaching this other roller means to the adapter shoe means intermediate the first and second ends.

In another preferred embodiment an off-centered longitudinal opening through the adapter shoe means permits fluid flow through the apparatus, which flow engages and thereby tends to rotate the roller means.

From the foregoing, it is an object of the present invention to provide a novel and improved apparatus for assisting the lowering of an object into a well by keeping the object from becoming stuck on a ledge in an uncased well bore, for example. It is also an object of the present invention that such apparatus have a simple construction so that it is easy to use and maintain and simple and inexpensive to manufacture. It is also an object to provide a construction which enhances the dislodgment feature by providing a construction which imparts a rotational movement tending to kick or move the object away from a wall in the well bore.

Other and further objects, features and advantages of the present invention will be readily apparent to those skilled in the art when the following description of the preferred embodiment is read in conjunction with the accompanying drawings.

BRIEF DESCRIPTION OF THE DRAWINGS

FIG. 6 is a sectional elevational view taken along line 6—6 shown in FIG. 2.

DESCRIPTION OF THE PREFERRED EMBODIMENT

Because the present invention is related to the invention disclosed in my U.S. Pat. No. 4,474,235, that patent is incorporated herein by reference. The improvements in my invention claimed herein and a first preferred embodiment will next be described with reference to FIGS. 1–7.

The first-described preferred embodiment of the present invention provides an apparatus 2 for assisting the lowering of an object into a well having a wall in a similar manner to that disclosed in my aforementioned U.S. Patent. However, the present apparatus 2 provides an enhanced operability in achieving the same ultimate result of my previous invention.

Figure 1:
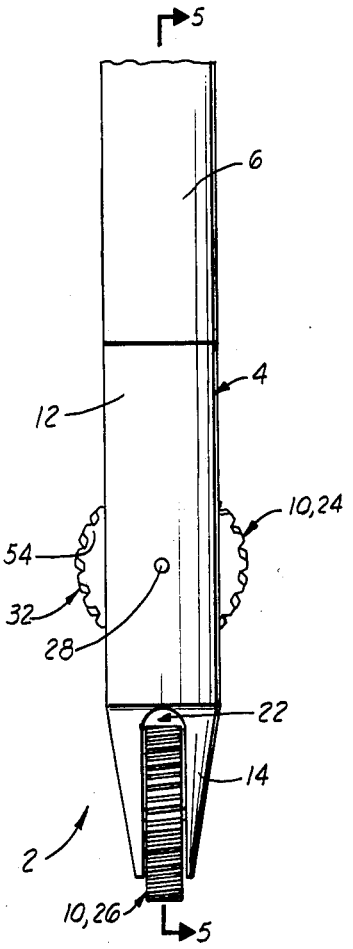
FIG. 1 is a first elevational view of a first preferred embodiment of the present invention shown attached to a lower end of a tool.
Figure 2:
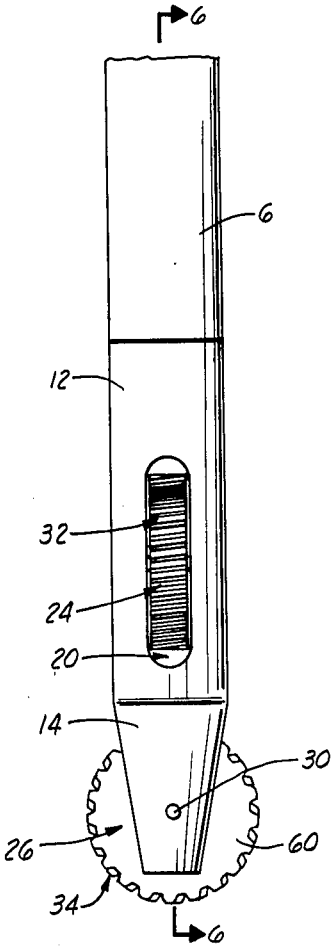
FIG. 2 is another elevational view of the first preferred embodiment of the present invention.
Figure 3:
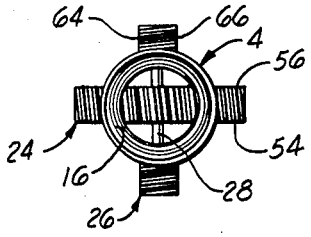
FIG. 3 is a top view of the first preferred embodiment of the present invention.
Figure 4:
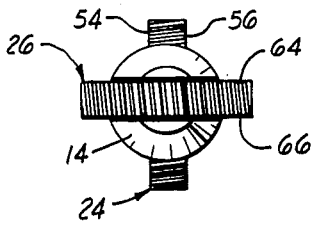
FIG. 4 is a bottom view of the first preferred embodiment of the present invention.
Figure 5:
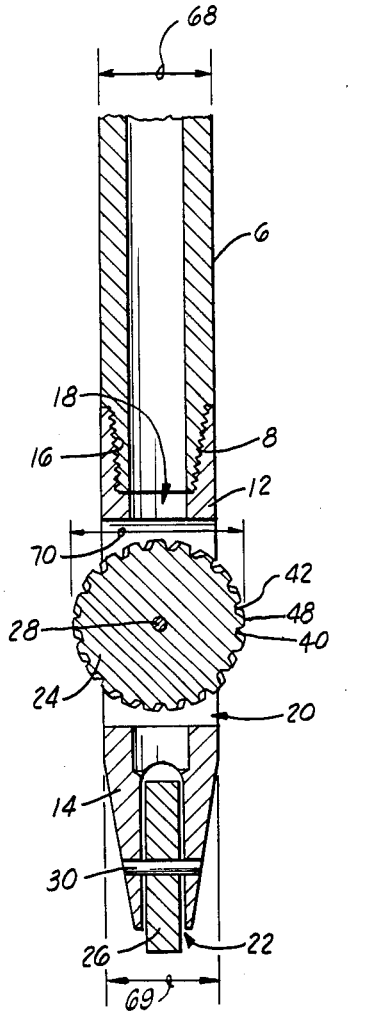
FIG. 5 is a sectional elevational view taken along line 5—5 shown in FIG. 1.
Figure 5:
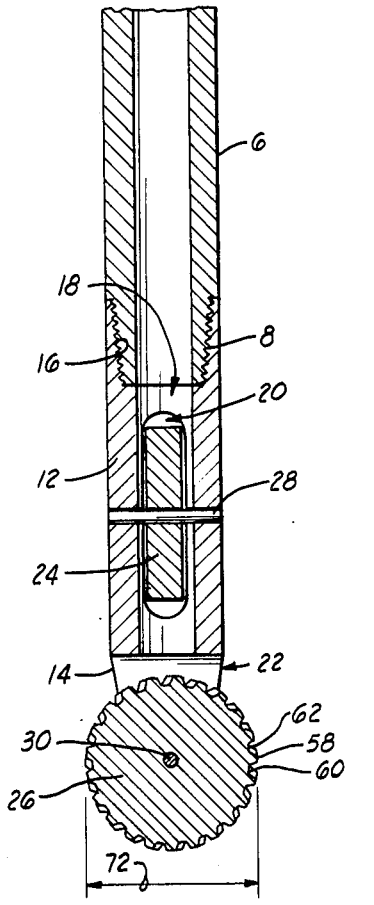

The apparatus 2 includes adapter shoe menas 4 for coupling the apparatus 2 with a tool 6, such as a well logging tool having a threaded pin end 8 as shown in FIGS. 5 and 6. The apparatus 2 also includes roller means 10 for engaging the wall of the uncased well bore in the exemplary use of the present invention. The apparatus 2 further includes attachment means for attaching the roller means 10 to the adapter shoe means 4 as will be more particularly described hereinbelow.

The adapter shoe means 4 of the preferred embodiment includes a tubular sleeve defined by a cylindrical wall or member 12 having two longitudinally spaced ends. At the lower end, there is integrally formed with the cylindrical member 12 a brace means 14 forming part of the attachment means for attaching the roller means 10 to the adapter shoe means 4. The brace means 14 of the preferred embodiment is defined by walls inwardly tapering towards each other as the brace means 14 extends axially or longitudinally from the cylindrical wall 12. Defined at the upper end of the cylindrical member 12 is means for receiving an end of the tool 6. This receiving means of the preferred embodiment includes a box end 16 forming part of a hollow interior region which also includes a longitudinal opening 18 extending axially through the further length of the cylindrical member 12. Intersecting the longitudinal opening 18 intermediate the two ends of the cylindrical member 12 is a diametric slot 20. The slot 20 extends longitudinally through diametrically opposite portions of the annular wall defining the cylindrical member 12. Also communicating with the longitudinal opening 18 is a slot 22 defined in the brace means 14. The slot 22 laterally opens in a direction which is perpendicular to the direction of the diametric slot 20. The communicating hollow constructions of the member 12 and the brace means 14 allow for circulation to occur through the present invention for purposes readily apparent to those skilled in the art. The member 12, and the other elements comprising the present invention, are made of any appropriate type of material suitable for use in an uncased well bore for the preferred embodiment described herein. Such a material is known to the art.

The roller means 10 of the preferred embodiment includes two separate roller elements shown specifically as wheels 24, 26. The wheel 24 is disposed through the slot 20, and the wheel 26 is disposed in the slot 22. Because of the construction of the slots, the wheels 24, 26 mounted therein are longitudinally and angularly displaced relative to each other.

The wheel 24 is rotatably connected to the cylindrical member 12 within the slot 20 by means of an axle 28 suitably journaled in the side wall of the cylindrical member 12. The wheel 26 is similarly rotatably mounted in the brace means 12 by means of an axle 30. The axles 28, 30 define portions of the aforementioned attachment means of the apparatus 2. Each of the wheels 24, 26 is retained on an axis of rotation which is perpendicular to, and which intersects, the longitudinal axis of the cylindrical member 12. The wheel 26 is specifically located on an extension of the longitudinal axis below the lower end of the cylindrical member 12 so that the wheel 26, rather than the end of the apparatus 2, will engage the wall of the well bore.

To provide a gripping or traction-improving structure to the periphery of the wheels 24, 26, each of these wheels includes a plurality of protuberances which may be referred to as teeth. In the illustrated preferred embodiment, the wheel 24 has teeth 32 spaced around the circumference of the wheel. The wheel 26 has a similar plurality of teeth 34 defined around the circumference thereof. The preferred embodiment construction of these teeth will be more specifically described with reference to FIG. 7.

Figure 7:
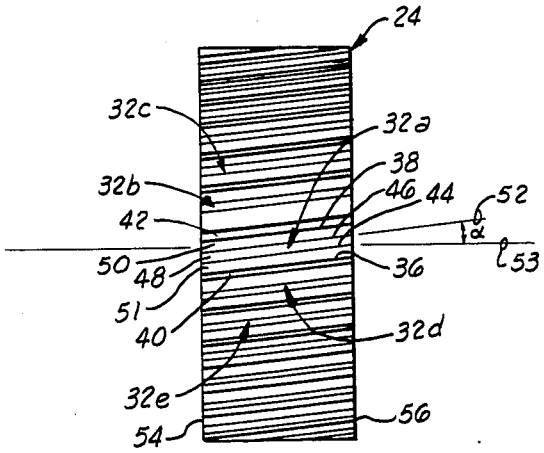
FIG. 7 is an enlarged edge view of one of the roller means of the preferred embodiment of the present invention.

FIG. 7 shows an enlarged edge view of the wheel 24. Several adjacent teeth are indicated by the reference numerals 32*a*, 32*b*, 32*c*, 32*d*, 32*e*, respectively. Each of these teeth, as well as the others disposed around the periphery of the wheel 24, as well as those defined around the periphery of the wheel 26, are similarly constructed; therefore, the specific construction of only the tooth 32*a* will be further described.

In the preferred embodiment the tooth 32*a* protrudes outwardly from corner lines 36, 38 defining boundaries adjacent troughs or valleys 40, 42, respectively. The tooth 32*a* protrudes radially outwardly from the corner lines 36, 38 to edges 44, 46 which bound a crest surface 48. Inwardly tapering from the corner lines 36, 38 to the edges 44, 46 are side surfaces 51, 50, respectively. None of these elements 36–51 extends perpendicularly across the circumferential edge of the wheel 24 or, stated differently, parallel to the axis of rotation of the wheel 24. As shown in FIG. 7, each of these elements extends parallel to a line 52 on which the edge 46 is shown to lie. The line 52 is angularly displaced from a reference line 53 extending perpendicular to the planes in which side surfaces 54, 56 of the wheel 24 lie and parallel to or coincident with the axis of rotation of the wheel 24 about the axle 28. Because the angle between lines 52, 53, designated as angle $\alpha$, is a non-zero number of degrees in the preferred embodiment, each tooth 32 can be said to be disposed obliquely around the circumference of the wheel 24. Stated differently, the preferred embodiment wheels 24, 26 can be referred to as helically cut toothed members. This oblique angular construction of the teeth of the wheels 24, 26 is an important feature of the present invention in that it enables the teeth to impart a rotational force to the cylindrical member 12, and thus to any tool 6 connected thereto, when the teeth engage the wall of the well bore. This tends to rotate and kick the apparatus 2 and the tool 6 away from the wall to prevent the coupled apparatus 2 and tool 6 from becoming lodged against the wall.

The wheel 26 is similarly constructed. FIG. 5 is labeled to indicate that each of the teeth 34 has a similar construction extending to a crest or apex surface 58 from adjacent trough or valley surfaces 60, 62. These elements extend obliquely between side surfaces 64, 66 of the wheel 26.

Another important feature of the present invention includes the structural relationships among the adapter shoe means 4, the tool 6 and the roller means 10. Referring to FIGS. 5 and 6, the tool 6 is shown as having a maximum exterior lateral dimension represented by the dimension line 68. In the preferred embodiment the cylindrical member 12 has a maximum outer dimension represented by the dimension line 69 which is equal to the dimension 68 of the tool 6. The wheel 24 has a maximum outer dimension 70 measured perpendicularly to the direction of the longitudinal spacing between the ends of the cylindrical member 12. The wheel 26 has a maximum outer dimension 72 measured perpendicularly to the direction of the longitudinal spacing between the ends of the cylindrical member 12. In the preferred embodiment the dimensions 70, 72 are equal and are greater than the dimensions 68, 69. This relationship is important so that the teeth of the larger dimensioned rotatable wheels 24, 26 will engage the wall before the linear elements of the adapter shoe means 4 and the tool 6 can become wedged in the wall.

In using the present invention, the adapter shoe means 4 is threadedly attached to the tool 6 by coupling the pin end 8 and the box end 16 in a manner as known to the art (constructions permitting other types of connections between the apparatus 2 and its object can be used). In an exemplary use, the tool 6 is a logging tool; however, the present invention can be used with other tools and objects (e.g., casings and liners). The coupled apparatus 2 and tool 6 are then inserted into the well bore and lowered in a manner as known to the art. Should the coupled apparatus 2 and tool 6 laterally deviate within the well bore a sufficient amount during their descent, either the wheel 24 or the wheel 26 will engage the wall of the well bore first. Which wheel will engage the wall depends upon the angular orientation of the coupled apparatus 2 and tool 6 relative to the longitudinal axis of the linear cylindrical member 12 and the tool 6. When either of the wheels 24, 26 engages the wall, sufficient traction is achieved by means of the teeth 32, 34 so that the respective wheel 24, 26 tends to rotate and roll the apparatus 2 and tool 6 off of the wall. The oblique disposition of the teeth around the peripheries of the wheels further imparts a rotational force tending to rotate the apparatus 2 and the tool 6 about the longitudinal axis. This kicks the apparatus 2 and the coupled tool 6 away from the wall toward the open bore so that the apparatus 2 and tool 6 can be freely lowered farther into the well. Therefore, the preferred embodiment of the present invention simultaneously rolls and spins the tool 6 off the wall of the well.

Figure 8:
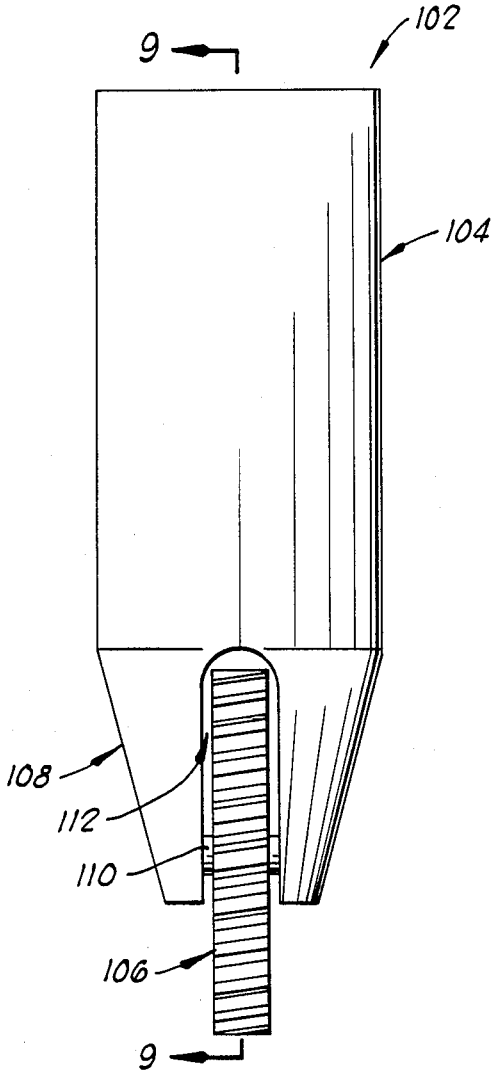
FIG. 8 is an elevational view of a second preferred embodiment of the present invention.
Figure 9:
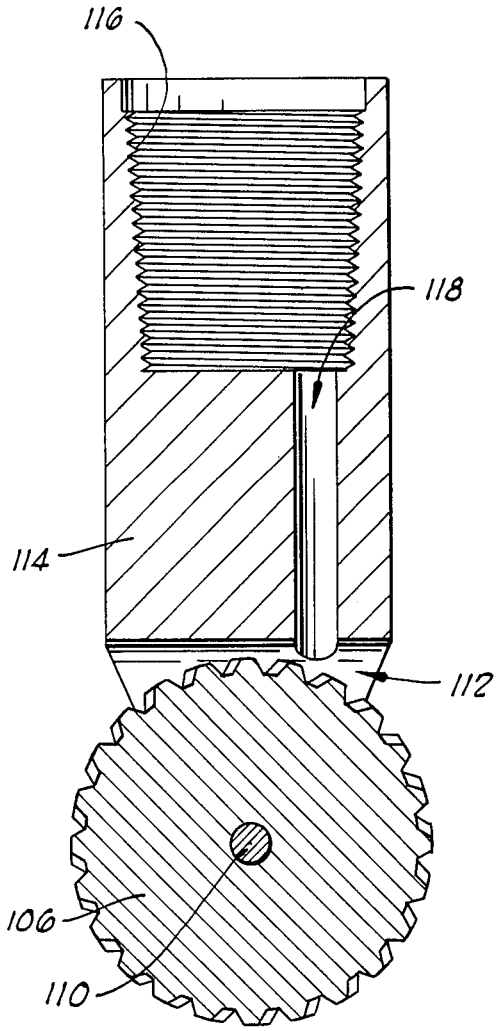
FIG. 9 is a sectional elevational view taken along line 9—9 shown in FIG. 8.
Figure 10:
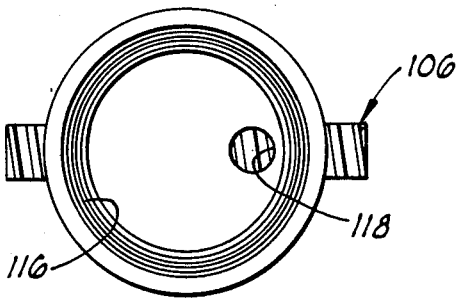
FIG. 10 is a top view of the second preferred embodiment of the present invention.

With reference to FIGS. 8–10, a second preferred embodiment of the present invention will be described. The apparatus of this embodiment is generally designated by the reference numeral 102. The apparatus 102 includes an adapter shoe means 104 having a single roller means 106 rotatably associated therewith by a brace means 108 and an axle 110 in a manner similar to the corresponding elements of the first embodiment. The brace means 108 defines a slot 112 in which the roller means 106 is disposed.

The adapter shoe means 104 includes a cylindrical member 114 having a threaded box end 116 defined in one end thereof. Extending axially from the other end of the cylindrical member 114 are the brace means 108 and the slot 112. Formed through the cylindrical member 114 in fluid communication between the bottom surface of the box end 116 and the upper surface of the slot 112 is an axially offset, longitudinal opening 118. The opening 118 is axially offset (i.e., spaced from the line along which the longitudinal axis of the cylindrical member 114 extends) so that fluid, received in the opening 118 through the box end 116 from the object to which the apparatus 102 is connectible, flows to the slot 112 for engaging the roller means 106 along a direction which is offset from or angularly related to a radius of the preferred embodiment of the roller means 106. This construction allows the flow to impinge upon and impart a rotational force to the roller means 106 so that the roller means 106 tends to spin about the axis 110 in response to the flow. This enhances the ability of the apparatus 102 to keep the object from becoming stuck on a ledge or other structure of the wall of the well bore.

The roller means 106 includes a toothed wheel constructed similarly to those described with reference to the first embodiment; therefore, no further description of the roller means 106 will be given except to state that the teeth, or protuberances, receive at least part of the flow coming from the opening 118.

The embodiment shown in FIGS. 8–10 is used in a manner similar to the first embodiment. Both of these embodiments with the longitudinal channels or openings defined therethrough are contemplated for use with objects from which fluids flow into the well bore as known to the art. However, the scope of the present invention is such that the adapter shoe means can be constructed with no longitudinal opening and with other types of connector means when such constructions are called for by the nature of the object with which the present invention is to be used.

Thus, the present invention is well adapted to carry out the objects and attain the ends and advantages mentioned above as well as those inherent therein. While preferred embodiments of the invention have been described for the purpose of this disclosure, numerous changes in the construction and arrangement of parts can be made by those skilled in the art, which changes are encompassed within the spirit of this invention as defined by the appended claims. For example, although the preferred embodiments have been described with reference to an uncased well bore, they can be used in other situations. As another example, no opening need be provided for permitting fluid flow when the present invention is used with objects through which no fluid flow is to occur. As a further example, the teeth can lie at different oblique angles relative to the sides of the roller members and/or relative to each other.

What is claimed is:

1. An apparatus for assisting the lowering of an object into a well having a wall, said apparatus comprising:

adapter shoe means for coupling said apparatus with the object, said adapter shoe means having a first end and a second end spaced from said first end;

first roller means for engaging the wall of the well, said first roller means having a first plurality of protuberances defined along the periphery thereof so that said protuberances engage the wall of the well to rotate said first roller means thereby tending to prevent the object from becoming stuck against the wall when said adapter shoe means couples said apparatus with the object and the object is lowered into the well, wherein said first roller means has a first side surface and a second side surface spaced from said first side surface, and each of said first plurality of protuberances is disposed between said first and second side surfaces at an oblique angle thereto; and first roller attachment means for attaching said first roller means near said second end of said adapter shoe means.

2. An apparatus as defined in claim 1, further comprising:

second roller means for engaging the wall of the well, said second roller means including a third side surface and a fourth side surface spaced from said third side surface, and including a second plurality of protuberances defined along the periphery thereof and disposed between said third and fourth side surfaces at oblique angles thereto; and second roller attachment means for attaching said second roller means to said adapter shoe means intermediate said first and second ends thereof.

3. An apparatus as defined in claim 1, wherein said adapter shoe means has an axially offset opening defined therethrough so that when a fluid flow through the object and the object is connected to said apparatus, the fluid flows through said opening and impinges upon said protuberances of said first roller means.

4. An apparatus as defined in claim 1, wherein:

said adapter shoe means includes a cylindrical wall having first and second ends respectively defining said first and second ends of said adapter shoe means and having a longitudinal opening defined therethrough between said first and second ends, said cylindrical wall having a first slot defined diametrically therethrough intersecting said longitudinal opening;

said first roller attachment means includes:

brace means extending from said second end of said cylindrical wall for defining a second slot which communicates with the longitudinal opening defined through said cylindrical wall; and means for rotatably connecting said first roller means to said brace means within said second slot; and said apparatus further comprises:

second roller means for engaging the wall of the well, said second roller means including a second plurality of protuberances defined along the periphery thereof; and second roller attachment means for attaching said second roller means to said adapter shoe means intermediate said first and second ends thereof, said second roller attachment means including means for rotatably connecting said second roller means to said cylindrical wall so that said second roller means extends through said first slot.

5. An apparatus as defined in claim 4, wherein:

said second roller means has a third side surface and a fourth side surface spaced from said third side surface; and each of said second plurality of protuberances is disposed between said third and fourth side surfaces at an oblique angle thereto.

6. An apparatus as defined in claim 5, wherein said cylindrical wall has an internally threaded opening defined within said longitudinal opening at said first end of said cylindrical wall for threadedly engaging the object.

7. An apparatus for assisting the lowering of an object into a well having a wall, said apparatus comprising:

adapter shoe means for coupling said apparatus with the object, said adapter shoe means having a first end and a second end spaced from said first end;

first roller means for engaging the wall of the well, said first roller means having a first plurality of protuberances defined along the periphery thereof so that said protuberances engage the wall of the well to rotate said first roller means thereby tending to prevent the object from becoming stuck against the wall when said adapter shoe means couples said apparatus with the object and the object is lowered into the well;

first roller attachment means for attaching said first roller means near said second end of said adapter shoe means; and wherein said adapter shoe means has an axially offset opening defined therethrough so that when a fluid flows through the object and the object is connected to said apparatus, the fluid flows through said opening and impinges upon said protuberances of said first roller means.

8. An apparatus as defined in claim 7, wherein:

said first roller attachment means includes:

brace means extending from said second end of said adapter shoe means for defining a slot which communicates with said axially offset opening; and means for rotatably connecting said first roller means to said brace means within said slot; and said adapter shoe means has an internally threaded opening communicating with said axially offset opening at said first end of said adapter shoe means for connecting with the object.

9. An apparatus for preventing a tool from becoming lodged on a ledge in a well bore, comprising:

a cylindrical member having defined therein receiving means for receiving an end of the tool;

a wheel having a circumference along which a plurality of radial teeth are obliquely disposed for imparting a rotational force to said cylindrical member when said teeth engage the ledge; and attachment means for rotatably attaching said wheel to said member so that said wheel rolls off the ledge when said teeth engage the ledge.

10. An apparatus as defined in claim 9, further comprising:

another wheel having a circumference along which a plurality of other radial teeth are obliquely disposed for imparting a rotational force to said cylindrical member when said other radial teeth engage the ledge; and another attachment means for rotatably attaching said another wheel to said cylindrical member in angularly spaced relation to said first-mentioned wheel.

11. An apparatus as defined in claim 9, wherein said cylindrical member has an opening defined therein providing a flow path between said receiving means and said wheel so that fluid flowing into said receiving means flows through said opening and impinges upon said wheel to provide a rotational force thereto.

* * * * *